US007225840B1

(12) United States Patent
Craig et al.

(10) Patent No.: US 7,225,840 B1
(45) **Date of Patent: *Jun. 5, 2007**

(54) DROP TUBE ASSEMBLY

(75) Inventors: Jon Craig, Findlay, OH (US); Mike Malec, Findlay, OH (US); Mike Harmon, Findlay, OH (US); Jeff Pulter, Monroe, MI (US)

(73) Assignee: Marathon Ashland Petroleum LLC, Findlay, OH (US)

( * ) Notice: Subject to any disclaimer, the term of this patent is extended or adjusted under 35 U.S.C. 154(b) by 121 days.

This patent is subject to a terminal disclaimer.

(21) Appl. No.: 11/141,432

(22) Filed: May 31, 2005

Related U.S. Application Data

(63) Continuation-in-part of application No. 10/894,373, filed on Jul. 19, 2004, now Pat. No. 6,932,123.

(51) Int. Cl.
*B65B 1/04* (2006.01)

(52) U.S. Cl. ..... 141/59; 141/95; 141/198

(58) Field of Classification Search ..... 141/1, 141/44, 45, 59, 96, 95, 198, 206, 392
See application file for complete search history.

(56) References Cited

U.S. PATENT DOCUMENTS

| | | | |
|---|---|---|---|
| 5,008,653 | A | 4/1991 | Kidd et al. |
| 5,174,345 | A | 12/1992 | Kesterman et al. |
| 5,235,999 | A | 8/1993 | Lindquist et al. |
| 5,507,326 | A | 4/1996 | Cadman et al. |
| 5,713,401 | A | 2/1998 | Weeks |
| 6,026,841 | A | 2/2000 | Kozik |
| 6,062,274 | A | 5/2000 | Pettesch |
| 6,155,294 | A | 12/2000 | Cornford et al. |
| 6,328,348 | B1 | 12/2001 | Cornford et al. |

*Primary Examiner*—Steven O. Douglas
(74) *Attorney, Agent, or Firm*—Emch, Schaffer, Schaub & Porcello Co., L.P.A.

(57) ABSTRACT

This drop tube loading arm assembly is adaptable for loading asphalt into tank trailers at marketing terminals. The telescoping drop tube employs guides made of steel rollers of polymers such as fluorocarbon polymers and aluminum. The guides are located in the annular space between the tubes in combination with increased radial clearance between the tubes or sleeves and in combination with protection for the overfill probe. With the addition of vapor control systems and overfill protection probes, the telescoping drop loading spouts are less susceptible to cold weather sticking problems.

19 Claims, 7 Drawing Sheets

DROP TUBE ASSEMBLY

CROSS REFERENCE TO RELATED APPLICATIONS

This application is a continuation-in-part of U.S. patent application Ser. No. 10/894,373 filed Jul. 19, 2004 now U.S. Pat. No. 6,932,123.

TECHNICAL FIELD OF THE INVENTION

This invention relates to a drop tube loading arm assembly, for loading volatile liquid storage tanks such as fuel tanks and asphalt tanks.

BACKGROUND OF THE INVENTION

The present relates to volatile liquid storage tanks and more particularly to such tanks having apparatus for reducing vapor generation when the tank is filing from the upper or top side of the tank. These tanks could include asphalt terminals, tank trucks, above ground petroleum fuel tanks, chemical storage tanks, mobile liquid storage containers, and the like. The focus of this invention will be on filling tank trucks from asphalt terminals. The invention, however, has application with other tank types as well.

Tanks can be mounted on tanker trucks or located underground at service stations. Tanker trucks are typically filled with the fluids using pumping equipment at the loading racks of marketing terminals, and underground storage tanks are typically gravity-filled from the trucks. An overfill protection device is used with each tank to disable the pumping equipment at the marketing terminals or to close a truck-mounted flow valve at the service station when the limit of the recipient tank's capacity is reached.

Detection probes are placed near sources such as gasoline or asphalt storage tanks. The probes are connected by wires to a central monitoring station which monitors the probe status. These detection probes include overfill probes.

Asphalt loading arms have a history of cold weather sticking problems. Two and three stage telescoping drop tube loading arms have been used in the past to meet this problem. Both trailers and spouts could be positioned in marketing terminals to save lane time. The telescoping drop spouts were less susceptible to cold sticking problems due to the geometry being a direct drop.

With the addition of vapor control systems and overfill protection probes, the telescoping drop loading spout configuration became more complex. The vapor control telescoping loading spouts frequently had smaller annular clearances between tubes. In colder weather, sticking problems occurred due to the smaller annular clearances. Other problems surfaced as well.

BRIEF DESCRIPTION OF THE INVENTION

As a result, we developed a novel drop tube loading arm assembly. The assembly especially is adaptable for loading asphalt into tank trailers at marketing terminals. The telescoping drop tube employs placed guides made of aluminum or polymers such as fluorocarbon polymers and strategically placed aluminum guides. The guides are located in the annular space between concentric tubes. This in combination with increased radial clearance between the tubes or sleeves and in combination with protection for the overfill probe, has greatly improved the cold weather sticking problem.

The telescopic drop tube assembly of this invention for use with a tank while filling the tank from a liquid source comprises a first hollow drop tube having a length, a hollow interior, an exterior, an upper end adaptable for coupling to the liquid source and a lower end; and a second hollow drop tube having a length, a hollow interior, an exterior, an upper end, a lower end and a spout connected to the lower end adaptable for coupling to a tank. A portion of the upper end of the second drop tube circumscribes and forms a sleeve around an exterior portion of the lower end of the first drop tube. The second drop tube then is slidably mounted around the exterior of the first drop tube. A fluid overfill detector probe is connected to the spout; as is a vapor recovery nozzle. For a three stage loading tube the polymer guides are connected to the interior of the second and third sleeve, and aluminum guides are connected to the exterior on all three sleeves.

A two stage loading tube is similar to a three stage loading tube except the upper middle tube with guide assembly is omitted.

DETAILED DESCRIPTION OF THE INVENTION

In a preferred embodiment, a glide rail is connected to the exterior of the first drop tube, and the second drop includes an annular slot, wherein the annular slot is slidably mounted against the glide rail. The assembly also includes circuitry and a monitor wherein the circuitry connects the fluid overfill detection probe to the monitor. A controller and its circuitry connects the controller between the monitor and the liquid source. A vapor recovery hose and a vapor recovery manifold as included wherein the vapor recovery hose connects the vapor recovery nozzle to the vapor recovery manifold. In another preferred embodiment, a protective plate connected to the spout to protect the fluid overfill detector probe.

The polyfluorocarbon polymer guide varies widely. Preferably, the guide is a polyfluorocarbon polymer. This term includes polytetrafluoroethylene (PTFE), polymers of chlorotrifluoroethylene, fluorinated ethylene-propylene and the like. The term also includes copolymers of these polymers. Preferably, the polyfluorocarbon is tetrafluoroethylene hexafluoropropylene vinylidene fluoride (THV) copolymers.

Preferably, the guide is made from DuPont's Teflon™ polymer, which is a tetrafluoroethylene (TFE) fluorocarbon polymer.

In addition to the preceding combination of elements, the drop tube assembly of this invention preferably includes the following features: add to plate to protect probe, position bucket hook, add lock down handle, use Sch. 40 SST instead of aluminum, make collar threaded SST for easy access to guides, make plate removable for easy access to guides, with radial clearance of ¼" for both sleeves, fully weld guides on pipe OD, make handles from 1" aluminum, provide easy way to identify locking lug position, add bolt & nut to be field welded to existing cross bar (design upper bracket for lower or higher profile), and add 1" aluminum pipe handle to locate the locking lug.

Figure 1:
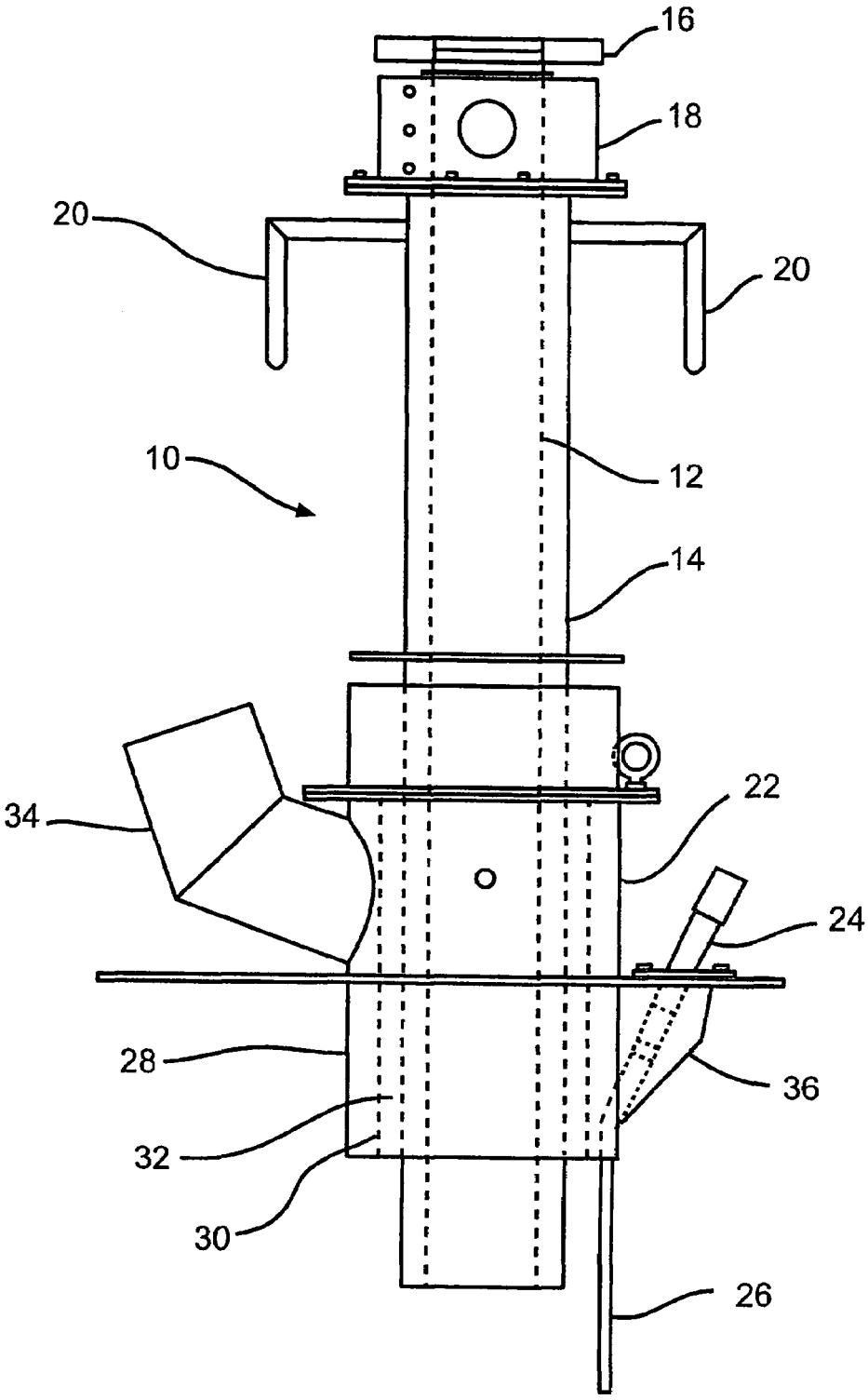
FIG. 1 is a side view of the telescopic drop tube assembly of this invention showing the tubes in a retracted position.

FIG. 1 is a side view of the telescopic drop tube assembly of this invention showing the tubes in a retracted position. FIG. 1 shows drop tube assembly 10, which includes first hollow tube 12 and second hollow tube 14. Coupling 16 connects tube 12 a liquid source (not shown). Fitting 18 attaches to the upper end of tube 14. Fitting 18 and tube 14 circumscribe tube 12 and are slidably mounted around the exterior of tube 12. Preferably, fitting 18 is collar threaded SST for easy access to the guides. Handles 20 typically are one inch aluminum rods for moving tube 14 upwardly or downwardly along tube 12. Movement may be manually or automated with electronic or mechanical means.

Spout 22 is connected to the lower end of tube 14 and is adaptable for coupling to a tank. Fluid overfill detector probe 24 is connected to spout 22. Probe 24 includes sensor pipe 26. Probe 24 through sensor pipe 26 detects a fluid state of their respective environments. Probe electronics connects probe 24 to a monitor via conventional electrical cable. The monitor may provide a signal for detecting a fluid environment or it may automatically shut off the flow of fluid.

Spout 22 also comprises a pair of hollow tubes with a void therebetween. Spout 22 comprises exterior tube 28, interior tube 30 and void 32 therebetween. Vapor recovery nozzle 34 connects to exterior tube 28 and communicates with void 32. Vapor recovery nozzle connects to a vapor recovery manifold via a vapor recovery hose.

Vapor recovery manifold and vapor recovery hose may be a conventional system or they may be a vapor recovery system as described in copending patent application Ser. No. 10/894,173, filed Jul. 19, 2004, entitled Loading Rack Odor Control, the disclosure of which is herein incorporated by reference.

FIG. 1 also shows probe protector plate 36.

Figure 2:
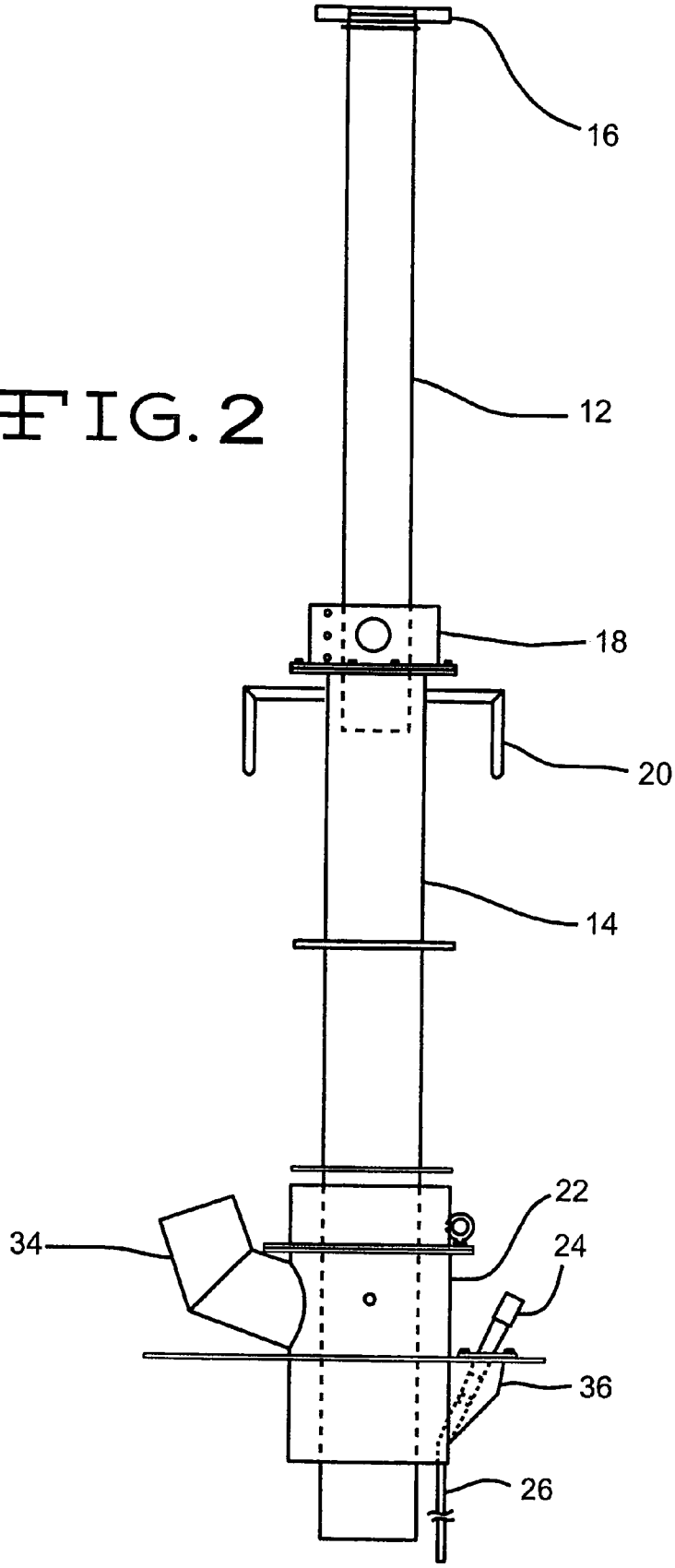
FIG. 2 is a side view of the telescopic drop tube assembly of FIG. 1 showing the tubes in a extended position.

FIG. 2 is a side view of the telescopic drop tube assembly of FIG. 1 showing the tubes in an extended position. Tube 14 is lowered to the lower end of 12. In this fashion tube 14 telescopically drops around tube 12 with fitting 18 remaining engaged to the outer surface of tube 12.

Figure 3:
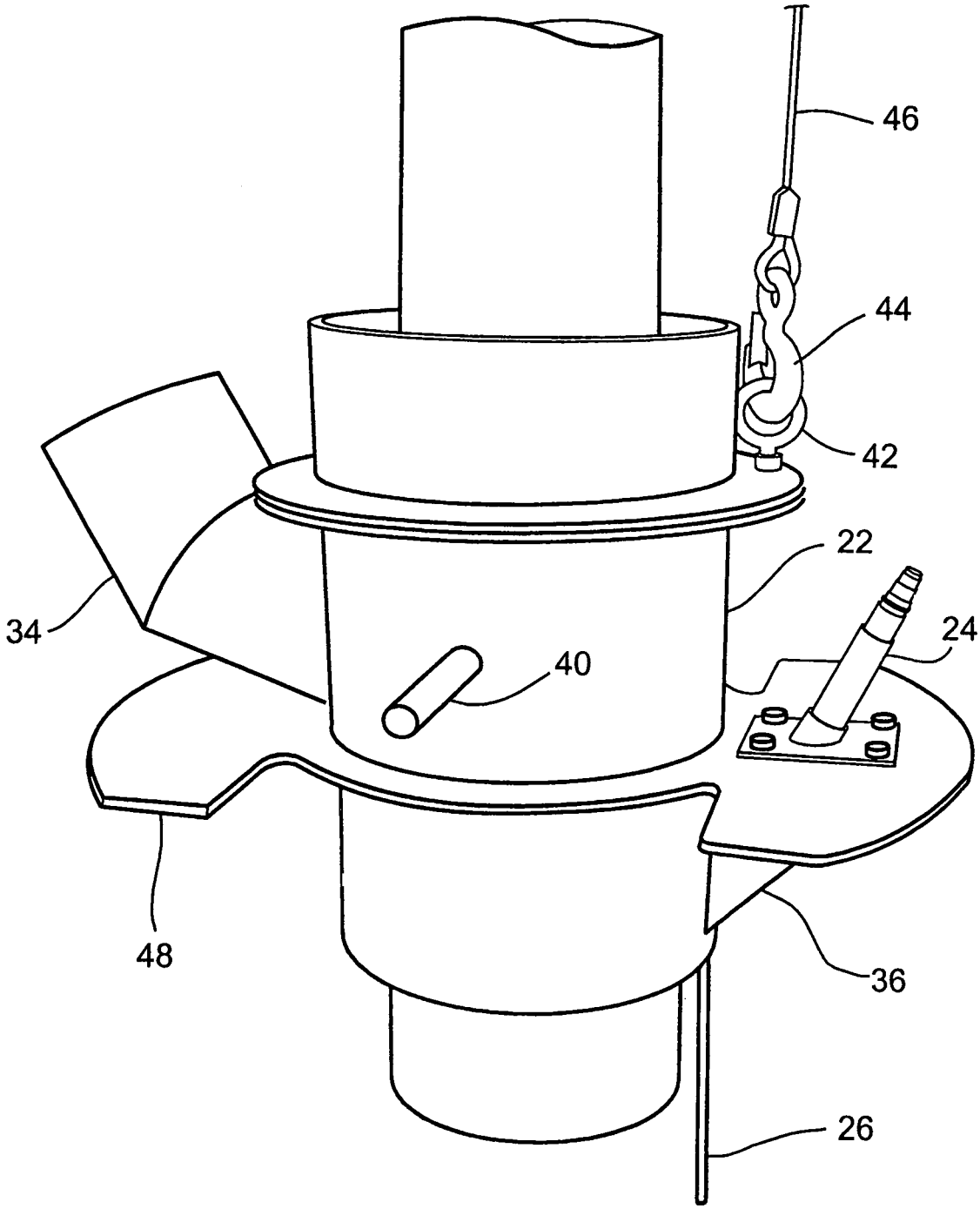
FIG. 3 is an enlarged, fragmentary sectional view showing the spout, fluid detector overfill probe and vapor recovery nozzle in greater detail.

FIG. 3 is an enlarged, fragmentary sectional view showing spout 22, fluid detector overfill probe 24 and vapor recovery nozzle 34 in greater detail.

FIG. 3 shows platform 48 circumscribing spout 22 and housing probe 24. Spout 22 also includes handles 40 for ease of movement. Also shown is eyelet bolt 42 secured to spout 22. One end of hook 44 couples to eyelit bolt 42 and the other end of hook 44 is attached to cable 46. Cable 46 attached to a standard or custom winch or hoist. The wrench or hoist may be electronic, hydraulic or pneumatic. Electric worn drives and wire rope hoists may be used as well. These means are used for lifting, lowering, and positioning spout 22.

FIG. 3 also shows platform 48 circumscribing spout 22 and housing probe 24.

Figure 4:
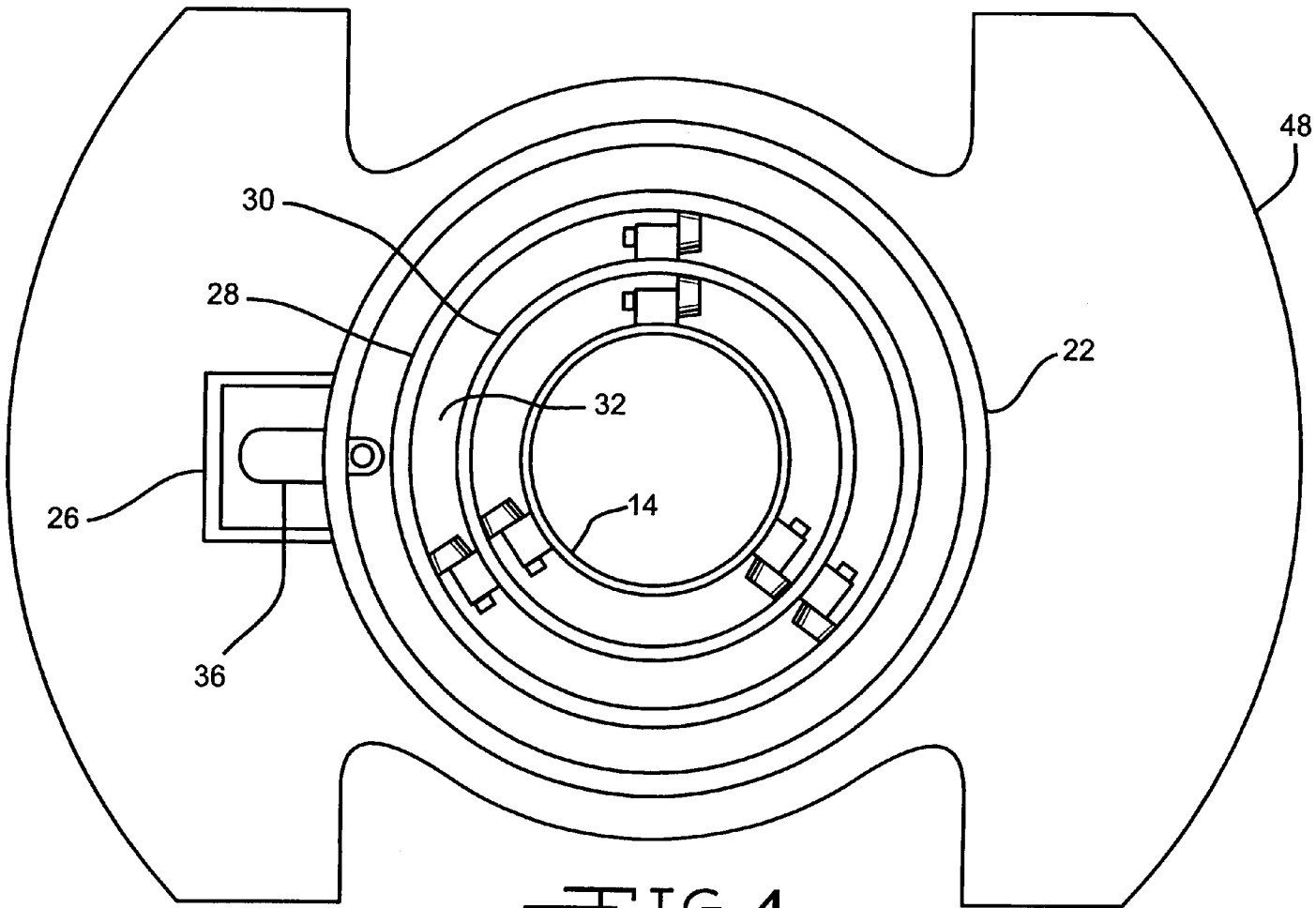
FIG. 4 is an end view showing the annular spacing of the spout and telescopic end tubes.

FIG. 4 is an end view showing the annular spacing of the spout and telescopic end tubes. FIG. 4 shows tube 14, exterior tube 28 and interior tube 30 in greater detail. Void 32 between tube 28 and tube 30 also is shown. Sensor pipe 26 and protector plate 36 also are shown. FIG. 4 shows a plurality of guides 52 connected to the exterior of tube 30 and engaging the interior of tube 28. FIG. 4 also shows a plurality of guides 58 connected to the exterior of tube 14 and engaging the interior of tube 30. While a plurality of guides is shown, any number of guides may be employed in the voids between tubes. The guides may slidably or rotatably engage the surfaces of the tubes. As will be shown in FIG. 6, the guides may be arranged in a mirror image of those shown in FIG. 4.

Figure 5:
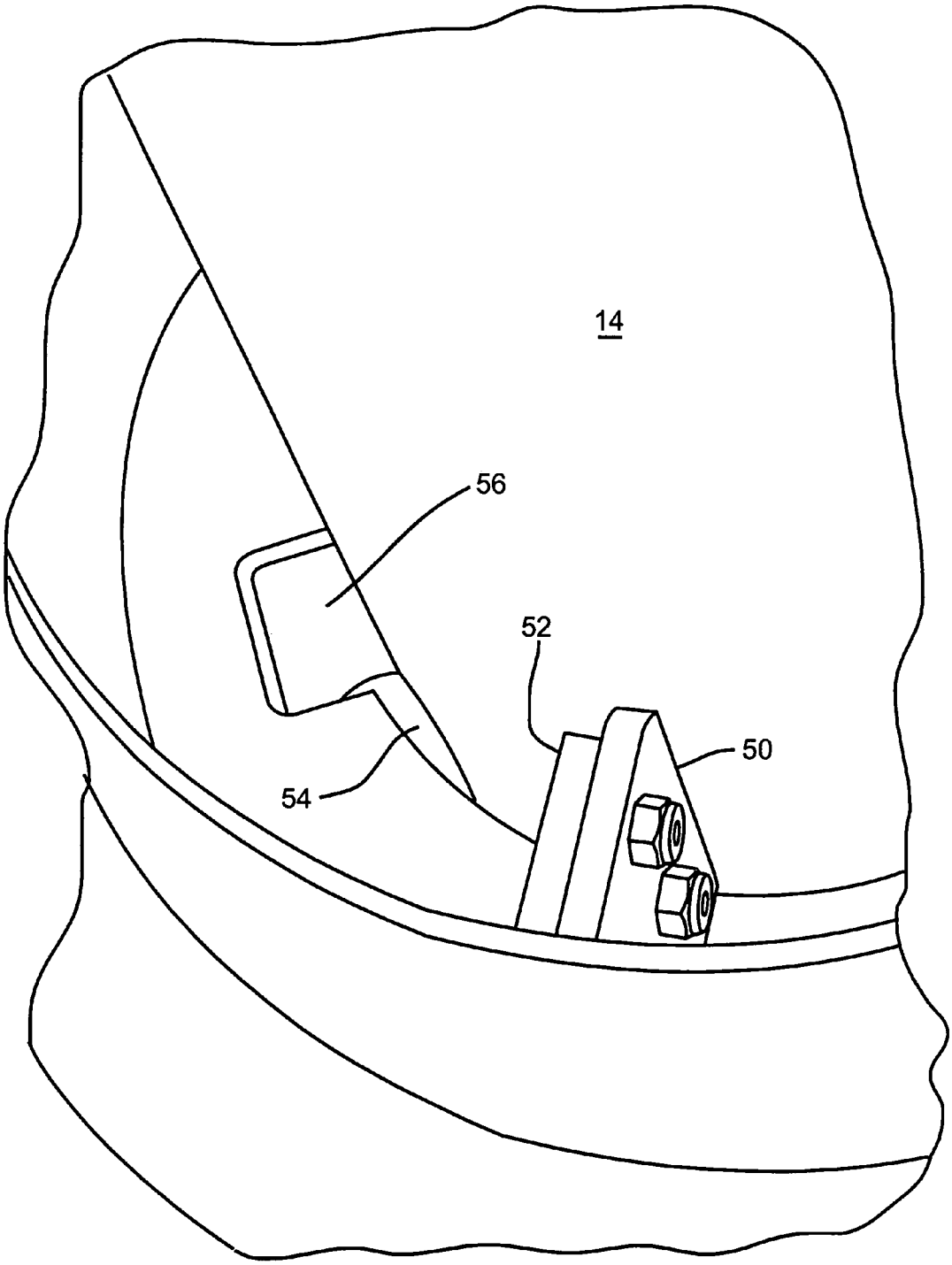
FIG. 5 is an enlarged, fragmentary sectional showing the polymer guides, annular space and annular glide rails in greater detail.

FIG. 5 is an enlarged, fragmentary sectional showing the polymer guides, annular space and annular glide rails in greater detail. FIG. 5 shows polymer guide 50 bolted to flange 52. Guides 50 may be a metal such as aluminum or a plastic such as a flurocarbon polymers. Flange 52 is welded to the interior of spout 22. Glide rail 54 is welded to the exterior of tube 14 and spout 22 includes annular slot 56 which is slidably mounted against glide rail 54.

Figure 6:
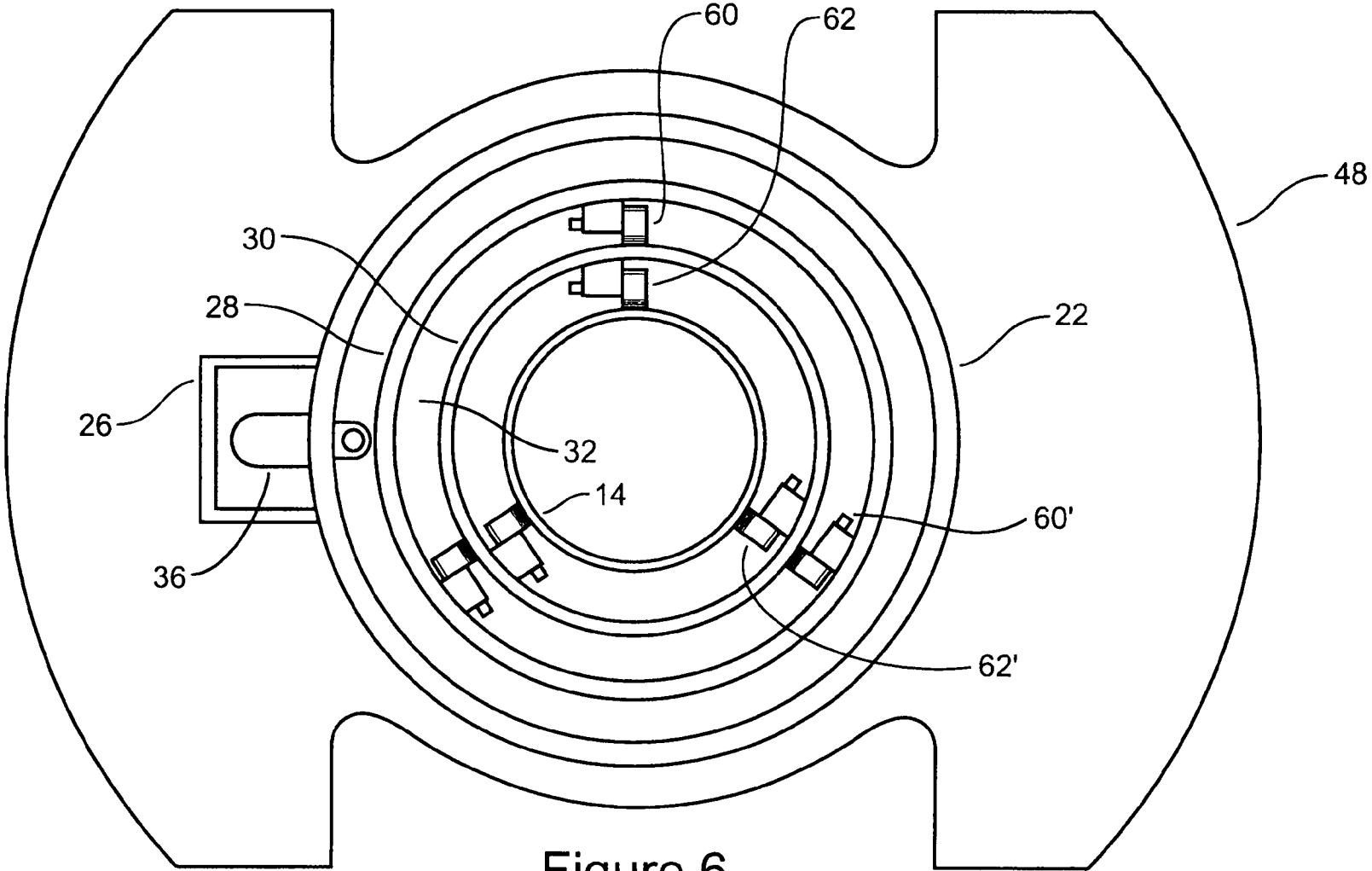
FIG. 6 is an end view showing rotating guides in the voids between end tubes.

FIG. 6 is another end view showing the annular spacing and guides between tubes. FIG. 6 shows a plurality of guides 60 connected to the interior of tube 28 and rotatably engaging the exterior of tube 30. FIG. 6 also shows a plurality of guides 62 connected to the interior of tube 30 and rotatably engaging the exterior of tube 14. Rotating portion 60' and 62' of guides 60 and 62 respectively, may be a wheel, roller, roller bearing, ball or ball bearing. Preferably rotating portion 60' and 62' is a wheel or roller.

Figure 7:
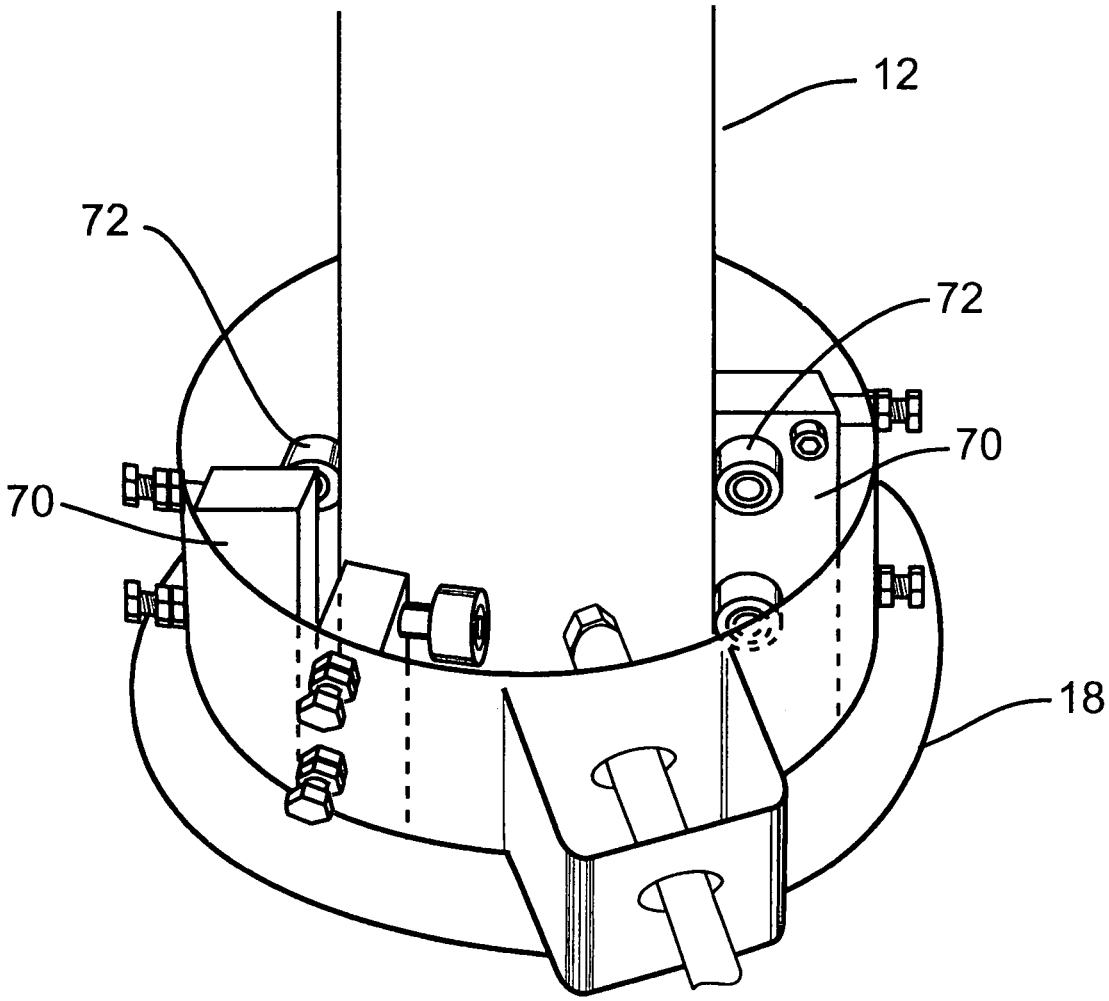
FIG. 7 is a downward perspective view showing rotating guides engaging a tube of the assembly.

FIG. 7 is a downward perspective view showing rotating guides engaging a tube of the assembly. FIG. 7 shows a plurality of guides 70 connected to the interior of fitting 18 and engaging the exterior of tube 12. Rotating portion 72 of guides 70 may be a wheel, roller, roller bearing, ball or ball bearing. Preferably rotating portion 72 is a wheel or roller.

In addition to these embodiments, persons skilled in the art can see that numerous modifications and changes may be made to the above invention without departing from the intended spirit and scope thereof.

We claim:

1. A telescopic drop tube assembly for use with a tank while filling the tank from a liquid source, the assembly comprising:

a first hollow drop tube having a length, a hollow interior, an exterior, an upper end adaptable for coupling to the liquid source and a lower end;

a second hollow drop tube having a length, a hollow interior, an exterior, an upper end, a lower end;

a spout connected to the lower end of the second hollow drop tube adaptable for coupling to a tank, wherein a portion of the upper end of the second drop tube circumscribes and forms a sleeve around an exterior portion of the lower end of the first drop tube;

wherein the second drop tube is mounted around the exterior of the first drop tube;

a fluid overfill detector probe connected to the spout;

a vapor recovery nozzle connected to the spout; and a guide connected to the interior second drop tube mounted against the exterior of the first drop tube;

wherein the guide connected to the interior second drop tube slidably engages the exterior of the first drop tube.

2. A drop tube assembly according to claim 1 wherein a glide rail is connected to the exterior of the first drop tube, wherein the second drop includes an annular slot, wherein the annular slot is slidably mounted against the glide rail.

3. A telescopic drop tube assembly for use with a tank while filling the tank from a liquid source, the assembly comprising:

a first hollow drop tube having a length, a hollow interior, an exterior, an upper end adaptable for coupling to the liquid source and a lower end;

a second hollow drop tube having a length, a hollow interior, an exterior, an upper end, a lower end;

a spout connected to the lower end of the second hollow drop tube adaptable for coupling to a tank, wherein a portion of the upper end of the second drop tube circumscribes and forms a sleeve around an exterior portion of the lower end of the first drop tube;

wherein the second drop tube is mounted around the exterior of the first drop tube;

a fluid overfill detector probe connected to the spout;

a vapor recovery nozzle connected to the spout; and a guide connected to the interior second drop tube mounted against the exterior of the first drop tube;

wherein the guide connected to the interior second drop tube rotatably engages the exterior of the first drop tube.

4. A drop tube assembly according to claim 3 wherein the guide includes at least one wheel, roller, roller bearing, ball or ball bearing engaging the exterior of the first drop tube.

5. A drop tube assembly according to claim 3 wherein the guide includes a pair of wheels or rollers engaging the exterior of the first drop tube.

6. A drop tube assembly according to claim 1 including circuitry and a monitor wherein the circuitry connects the fluid overfill detection probe to the monitor.

7. A drop tube assembly according to claim 6 including a controller and circuitry wherein the circuitry connects the controller between the monitor and the liquid source.

8. A drop tube assembly according to claim 1 including a vapor recovery hose and a vapor recovery manifold wherein the vapor recovery hose connects the vapor recovery nozzle to the vapor recovery manifold.

9. A drop tube assembly according to claim 1 wherein the liquid source is an asphalt marketing terminal.

10. A drop tube assembly according to claim 1 wherein the tank is a mobile tank trailer.

11. A drop tube assembly according to claim 1 wherein the polymer guide is a fluorocarbon polymer guide.

12. A drop tube assembly according to claim 11 wherein the polymer guide is a tetrafluoroethylene (TFE) fluorocarbon polymer guide.

13. A drop tube assembly according to claim 1 wherein the guide is an aluminum guide.

14. A drop tube assembly according to claim 1 including a protective plate connected to the spout to protect the fluid overfill detector probe.

15. A drop tube assembly according to claim 1 wherein the spout comprises a pair of hollow, concentric tubes with a void therebetween.

16. A drop tube assembly according to claim 15 wherein the concentric tubes of the spout comprise an interior tube and an exterior tube wherein the interior tube circumscribes the lower end of the second hollow tube of the drop tube assembly.

17. A drop tube assembly according to claim 16 wherein the vapor recovery nozzle extends through the exterior tube of the spout and communicates with the void between the concentric tubes.

18. A drop tube assembly according to claim 1 including:

a fitting having an interior circumscribing the upper end of the first hollow drop tube; and at least one rotating guide connected to the interior of the fitting and rotatably engaging the exterior of the first hollow drop tube.

19. A drop tube assembly according to claim 18 wherein the rotating guide connected to the fitting includes at least one wheel, roller, roller bearing, ball or ball bearing engaging the exterior of the first drop tube.

* * * * *